US005987146A

United States Patent [19]

Pluvinage et al.

[11] Patent Number: 5,987,146

[45] Date of Patent: Nov. 16, 1999

[54] EAR CANAL MICROPHONE

[75] Inventors: Vincent Pluvinage, Atherton; Jon C. Taenzer, Los Altos; Steven H. Puthuff, Saratoga, all of Calif.

[73] Assignee: ReSound Corporation, Redwood City, Calif.

[21] Appl. No.: 08/832,507

[22] Filed: Apr. 3, 1997

[51] Int. Cl.[6] ..... H04R 25/00

[52] U.S. Cl. ..... 381/328; 381/330; 381/381; 381/382

[58] Field of Search ..... 381/322, 328, 381/330, 327, 324, 60, 326, 381, 382, 380; 73/585; 128/746

[56] References Cited

U.S. PATENT DOCUMENTS

| | | | |
|---|---|---|---|
| 2,874,231 | 2/1959 | Wallace . | |
| 3,068,954 | 12/1962 | Strzalkowski | 381/328 |
| 3,676,611 | 7/1972 | Stephens . | |
| 4,291,203 | 9/1981 | Bellafiore . | |
| 4,882,762 | 11/1989 | Waldhauer | 455/72 |
| 5,031,219 | 7/1991 | Ward et al. . | |
| 5,195,139 | 3/1993 | Gauthier | 381/328 |
| 5,761,319 | 6/1998 | Dar et al. . | |
| 5,812,680 | 9/1998 | Glendon | 381/322 |

*Primary Examiner*—Huyen Le
*Attorney, Agent, or Firm*—Burns, Doane, Swecker & Mathis LLP

[57] ABSTRACT

An open ear canal hearing aid system is disclosed which comprises a plurality of ear canal tubes sized for positioning in an ear canal of a user so that the ear canal is at least partially open for directly receiving ambient sounds. The open ear canal hearing aid system further comprises a sound processor for amplifying ambient sounds received through one of the ear canal tubes within a predetermined frequency range and to produce processed sounds and for supplying the processed sounds to the second ear canal tube. According to other embodiments of the present invention, the speaker and/or microphone can be located in the ear canal at the end of the ear canal tubes. In these embodiments, the speaker and/or microphone are electrically connected to the sound processor by wires in the ear canal tubes.

30 Claims, 8 Drawing Sheets

EAR CANAL MICROPHONE

BACKGROUND OF THE INVENTION

1. Field of the Invention

The present invention relates to an open ear canal hearing aid system, and more particularly to an open ear canal hearing aid system including a sound processor for amplifying sounds included within a predetermined amplitude and frequency range and means for transmitting sounds to the ear canal and for receiving sounds which are in the ear canal.

2. State of the Art

Present day hearing aids have been developed to correct the hearing of users having various degrees of hearing impairments. It is well known that the hearing loss of people is generally not uniform over the entire audio frequency range. For instance, hearing loss for sounds at high audio frequencies (above approximately 1000 Hz) will be more pronounced for some people with certain common hearing impairments while hearing loss for sounds at lower frequencies (below approximately 1000 Hz) will be more pronounced for people having different hearing impairments.

The largest population of people having hearing impairments includes those having mild hearing losses with normal hearing in the low frequency ranges and hearing losses in the higher frequency ranges. In particular, the most problematic sounds for people having such mild hearing losses are high frequency sounds at low amplitudes (soft sounds).

Conventional hearing aids employ electronic hearing aid devices. Through various signal processing techniques, sounds to be delivered to the ear are rebuilt and supplemented to facilitate and optimize the hearing of the user throughout the usable frequency range. However, these devices block the ear canal so that little or no sounds reach the ear in a natural, unaided manner. Furthermore, such devices have drawbacks, such as feedback, when used with communication devices such as telephones.

Conventional hearing aids generally provide adequate hearing throughout the entire speech frequency range for most hearing impairments. However, these types of devices are not optimal for people having mild hearing losses for a number of reasons. Conventional hearing aids can unnecessarily amplify loud sounds so that these sounds become uncomfortable and annoying to the mild hearing loss users. In many hearing aids, such loud sounds are also distorted by the sound processing circuitry, significantly reducing the intelligibility of speech or the quality of other sounds. In addition, these types of hearing aids introduce phase shifts to received sounds, resulting in a reduction of the user's ability to localize sound sources. These hearing aids can therefore degrade certain sounds that the mild hearing loss user could otherwise hear adequately without any aid. Additionally, these traditional hearing aids are overly complicated and burdensome to users having mild hearing losses.

Efforts have been made to provide different gains for sounds of different frequencies, depending on the hearing needs of the user. For example, U.S. Pat. No. 5,276,739 to Krokstad discloses a device which amplifies sounds with different gains according to the frequencies of the sounds. While this device provides an improved gain response, it processes sounds across the entire frequency range, including low frequency sounds. Thus, this device suffers from the same problems noted above in accommodating the mild hearing loss user.

Other attempts to provide different gains for sounds of different frequencies employ multiband compression in which sounds of different frequency bands and different amplitudes are compressed by different amounts. For example, U.S. Pat. Nos. 5,278,912 and 5,488,668 to Waldhauer disclose multiband compression for hearing aids. Such systems apply compression to the entire frequency range, including low frequency signals. In the case of a user with mild hearing loss, compression for low frequency sounds is not needed. Applying compression to low frequency sounds thus results in a waste of money and space for the circuitry required to perform such compression and unnaturally and unnecessarily increases the amplitude of low level sounds.

Conventional hearing aid systems cause an additional problem known as the occlusion effect. The occlusion effect is the increased loudness of certain sounds due to transmission of sound by tissue conduction when the ear canal is blocked and air conduction is impeded, resulting in sounds which are both unnatural and uncomfortable for the user. In particular, the user's own voice sounds different than normal when the ear is blocked.

Vents have been introduced in hearing aid systems to provide pressure relief and to shape frequency responses. The vents are not designed to let sounds into the ear canal and do little to improve the occlusion effect. The occlusion effect therefore remains another drawback to using these traditional hearing aid systems.

In an effort to alleviate some of the aforementioned problems, some behind-the-ear (BTE) aids have been designed with a special tube fitting. These types of aids include a tube that extends into the ear canal and is held in place by an ear mold that leaves the ear canal generally unobstructed. The relatively open ear canal overcomes some of the problems mentioned above. However, these types of aids suffer from a number of other significant problems.

For example, like other BTE hearing aids, the "tube fitting" aids typically employ a rigid ear hook that connects to a soft tube which in turn connects to a rigid ear mold. The tubing is straight, but has the disadvantage that the tube does not hold the device in place. The result is that this type of BTE hearing aid requires a large ear hook and a large, hard, close-fitting ear mold to maintain the position of the tube within the ear canal. The large size of these components results in a cosmetically unattractive device. Also, the ear mold has to be custom-manufactured, which adds to the cost of the device and the time needed to fit the hearing aid.

U.S. Pat. No. 4,904,708 to Gorike discloses another type of hearing aid device in which the hearing aid is formed in a pair of eyeglasses. One drawback of this configuration is that the user is required to wear a custom made pair of eyeglasses, which adds to the cost of the device.

Another problem with these BTE devices is the fact that the microphone is located behind the ear. The microphone can have trouble picking up sounds from various directions because of being located behind the ear. In addition, the microphone can pick up too much background sound such as hair rubbing on a shirt when the user turns his/her head.

None of the above-described systems are directed to a hearing aid system which specifically solves only the hearing needs of people having mild hearing loss. Because people with mild hearing loss have normal hearing for many sounds, it is desirable to provide a hearing aid system which allows these sounds to pass through the ear canal unaided and to be heard in a natural manner and to only compensate and aid the sounds that the user has difficulty hearing. It is further desirable that such a hearing aid be cosmetically attractive and comfortable to wear while providing better sound pick-up for the microphone.

SUMMARY OF THE INVENTION

An open ear canal hearing aid system is disclosed which comprises a plurality of ear canal tubes sized for positioning in an ear canal of a user so that the ear canal is at least partially open for directly receiving ambient sounds. The open ear canal hearing aid system further comprises a sound processor for amplifying ambient sounds received through one of the ear canal tubes within a predetermined frequency range and to produce processed sounds and for supplying the processed sounds through another of the ear canal tubes. According to other embodiments of the present invention, the speaker and/or microphone can be located in the ear canal at the end of the ear canal tubes. In these embodiments, the speaker and/or microphone are electrically connected to the sound processor by wires in one or more ear canal tubes.

According to an alternate embodiment, the communications earpiece is configured to fit entirely in the ear wherein the ear canal is at least partially open for directly receiving ambient sounds.

BRIEF DESCRIPTION OF THE DRAWINGS

The present invention will be understood by reading the following detailed description in conjunction with the drawings, in which like parts are identified with the same reference characters and in which.

DETAILED DESCRIPTION OF THE PREFERRED EMBODIMENTS

Figure 1:
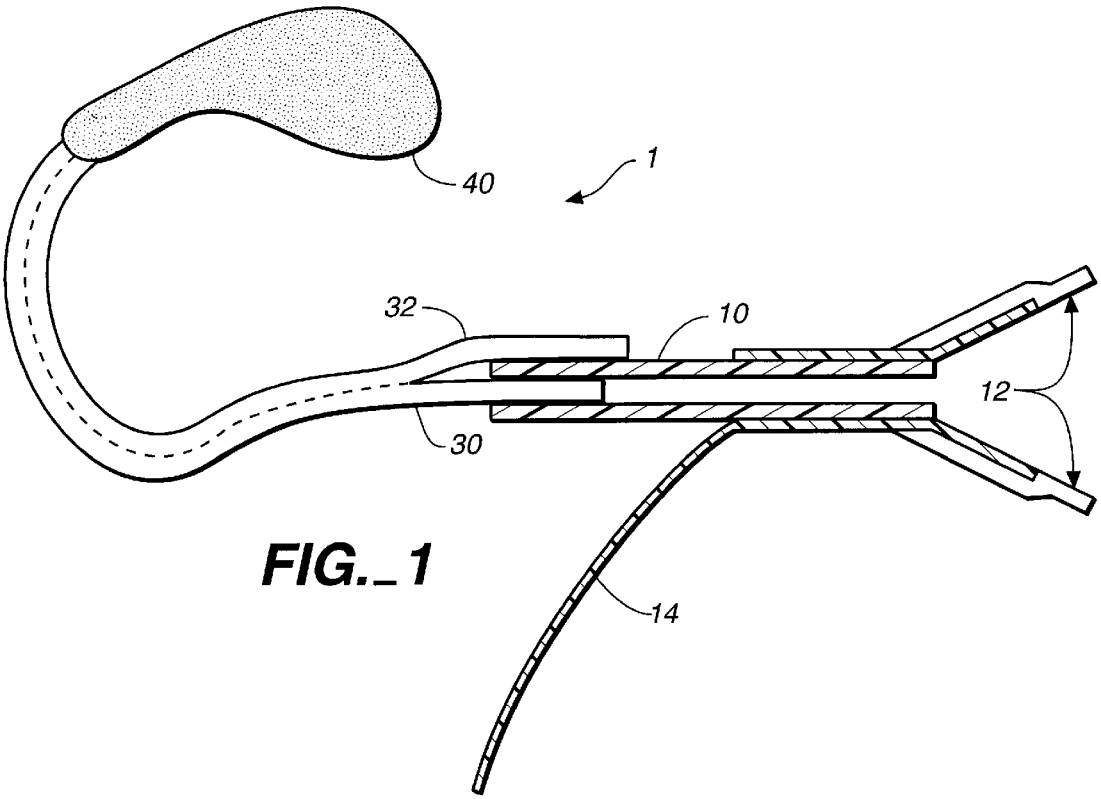
FIG. 1 illustrates an open ear canal hearing aid system according to one embodiment of the present invention.

In FIG. 1, an open ear canal hearing aid system 1 includes an ear canal tube 10 sized for positioning in the ear of a user so that the ear canal is at least partially open for directly receiving ambient sounds. The ear canal tube 10 is connected to a hearing aid tube 30. This connection can be made by tapering the ear canal tube 10 so that the hearing aid tube 30 and the ear canal tube 10 fit securely together. Alternately, a connector or the like can be used for connecting the ear canal tube 10 and the hearing aid tube 30, or the hearing aid tube 30 and the ear canal tube 10 can be incorporated into a single tube.

The hearing aid tube 30 is also connected to a case 40. The case 40 encloses a sound processor 48, a receiver 44, and a microphone 42, as will be described below with reference to FIG. 9. A second ear canal tube 32 is connected to an input of the microphone and extends into the ear canal of the user. The end of the ear canal tube 32 that is in the ear canal is open so as to receive ambient sounds. The ambient sounds then travel through the tube 32 to the input of the microphone 42. By locating the end of the microphone input in the ear canal, the sounds received at the microphone have better quality due to the filtering and reception of sounds by the human ear.

According to an exemplary embodiment, the case 40 is designed to fit behind the ear. However, the case 40 can be designed to fit in other comfortable or convenient locations. For example, the case 40 can be attached to or be a part of an eye glass frame.

FIG. 1 further shows a barb 14 that can be attached to one side of the ear canal tube 10. The barb 14 extends outward from the ear canal tube 10 so that it lodges behind the tragus for keeping the ear canal tube 10 properly positioned in the ear canal. The arrangement of the barb 14 in the ear canal is described in more detail with reference to FIGS. 5*a* and 5*b*. The barb 14 can be made of soft material (e.g., rubber-like material) so as not to scratch the ear tissue. At the end of the ear canal tube 10, the tip 12 can be soft so that the ear canal wall does not become scratched.

The tube 10 can be formed to the contour of the ear and can be made of a material that has some stiffness (e.g., plastic or other material). This makes the whole assembly, including the case 40, the tubes 10, 30, and 32, the barb 14, and the tip 12, work as a unit to maintain the location of the device upon the ear. The tube 10 can be made flexible enough to allow the hearing aid to be inserted and removed easily.

The tubing used for the tubes 10, 30, and 32 can have a circular, oval, or other shaped cross section. An oval shape, for example, allows the tubing to bend more easily in one dimension than in the other. This can be useful for allowing the tip end or the case end to be positioned up and down vertically while maintaining the tube 10 inside the canal.

According to an exemplary embodiment of the present invention, the tubing can be made small and thin. For example, the tubing can have an inner diameter of less than 0.030 inches (for example, approximately 0.025 inches) or any other practical dimension, and an outside diameter of less than 0.050 inches (for example, approximately 0.045 inches) or any other practical dimension, for most uses (compared to an outer diameter of 0.125 inches in conventional hearing aid systems). This small size makes the tubing less visible and therefore more cosmetically attractive.

In addition to the attractiveness of the small size, the small tubing provides at least one advantage for the speaker. Typical speakers are optimized for driving the low impedance of large diameter tubes or the even lower impedance of the canal cavity. This results in a large diaphragm and a large "dead space" behind the diaphragm. With the small tubing, the load is a high impedance, so the optimum diaphragm is much smaller and the "dead space" can be smaller without affecting the performance.

Figure 2:
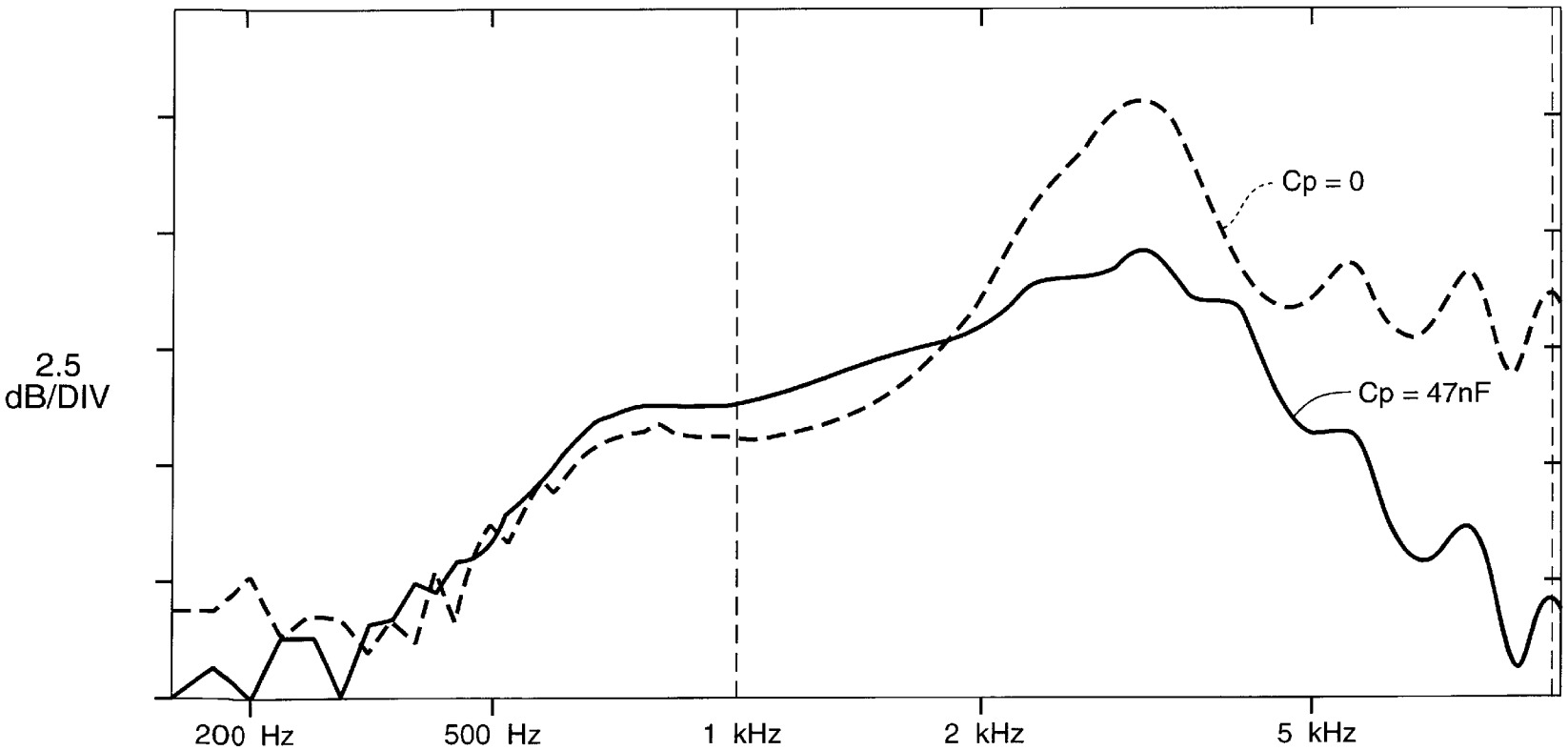
FIG. 2 is a graph which represents an example of the gain for various frequency input levels of sound received by an open ear canal hearing aid system having a small ear canal tube.

The present invention addresses the problem that, as the diameter of the tubing decreases, the frequency response varies farther from the desired shape. This is illustrated in FIG. 2 which shows a frequency response for a common class B speaker connected to a real ear simulator with a small diameter tube. The dashed line in FIG. 2 represents a normal frequency response with no capacitor connected to the speaker. As can be seen from FIG. 2, there is a large peak near 3 kHz. This can be a desirable response for some users, but not for others. The solid curve in FIG. 2 represents a frequency response using a 47 nf capacitor in parallel with the speaker when driven in the current mode. In this example, the speaker used was a Knowles model EH 3065. The capacitor helps shape the frequency response to a shape that is the preferred shape for most users. Other frequency shaping means can also be used to shape the frequency response, such as active electrical filters or acoustical filters. Additionally, the tip 12 can have different shapes or include horns which vary the frequency response, as explained with reference to FIGS. 3*a*–3*d*.

The tip 12 can be a separate component that fits over the tube 10 or can be formed as part of the tube. Using separate components for the tip 12 and the tube 10 permits more adjustment of each of these components and permits the materials of these components to be separately optimized.

Figure 3A:
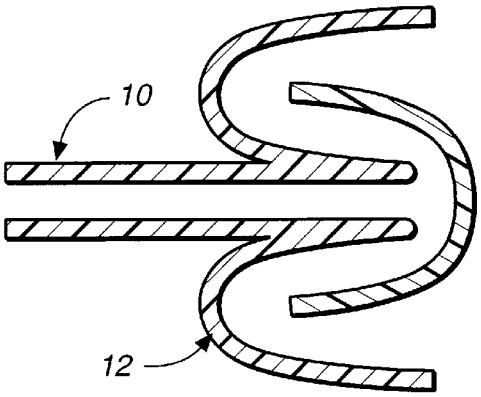
FIGS. 3*a*–3*d* show ear canal tube configurations according to additional embodiments of the present invention.
Figure 3B:
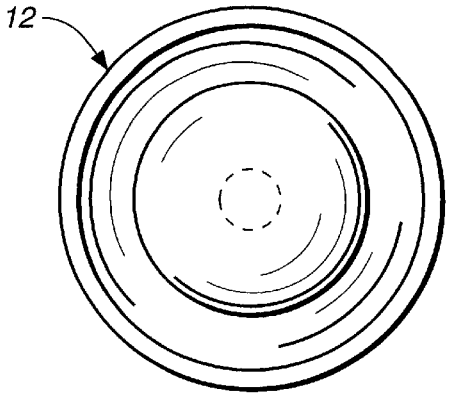
Figure 3C:
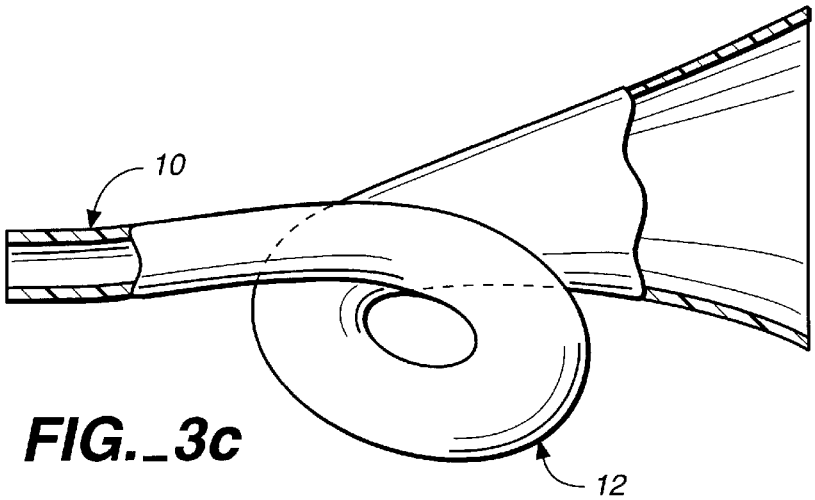
Figure 3D:
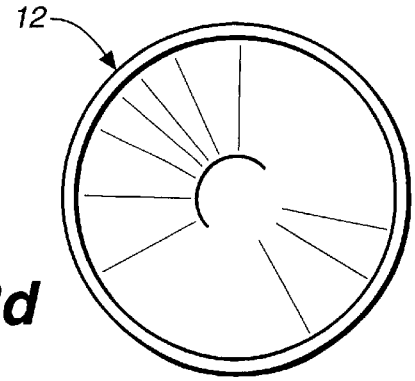

According to the present invention, the horn can be provided at the tip to improve the frequency response of the receiver. Examples of ear canal tube configurations employing horns according to the present invention are shown in FIGS. 3*a*–3*d*. In FIG. 3*a*, the tube opening folds back over the outside of the tube 10 and then folds back forward again. FIG. 3*b* shows an end view of the ear canal tube configuration shown in FIG. 3*a*. In FIG. 3*c*, the tube 10 forms a trumpet, i.e., a loop that gradually widens. FIG. 3*d* shows an end view of the ear canal tube configuration shown in FIG. 3*c*.

Figure 4A:
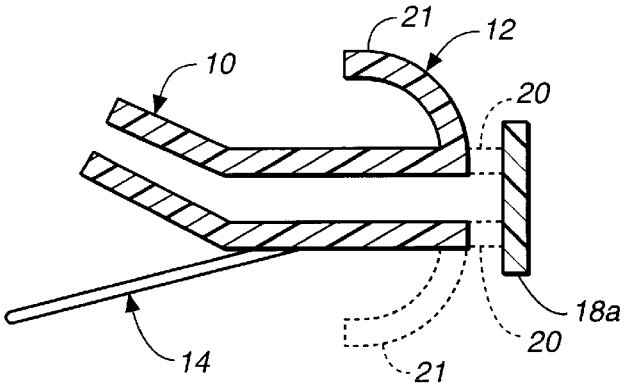
FIGS. 4*a*–4*d* show open ear canal hearing aid systems according to additional embodiments of the present invention.
Figure 4B:
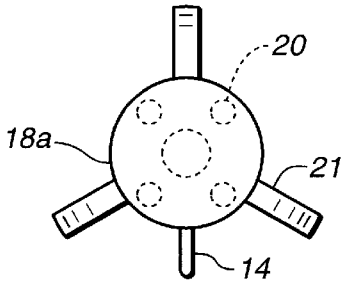
Figure 4C:
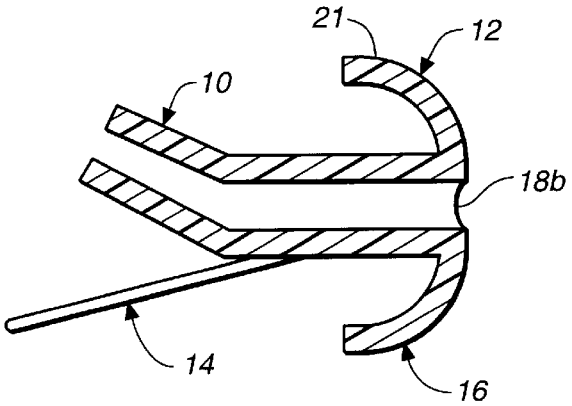
Figure 4D:
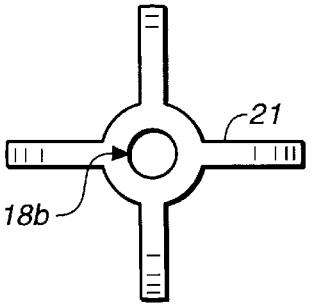

Yet another advantage of using separate tips is that the tips can be easily replaced or removed for cleaning. Wax and moisture pose potential problems for the tip. FIGS. 4*a*–4*d* show open ear canal hearing aid systems for reducing wax and moisture buildup according to the present invention. In FIG. 4*a*, a cross-sectional slice of a tip 12 having three support fingers 21 is provided, wherein the tube orifice is covered with a wax block 18*a* (attached, for example, adhesively or formed as an integral component) such that, during the insertion of the tube 10 in the ear, wax is prevented from entering the tube. The wax block 18*a* is supported in front of tip 12 via support posts 20. FIG. 4*b* shows an end view of the wax block 18*a* associated with the open ear canal hearing aid system shown in FIG. 4*a*. In FIG. 4*c*, a cross-sectional slice of a tip 12 having four support fingers 21 is provided, wherein a thin membrane 18*b* covers the end of the tube. This membrane can be made of plastic. The membrane 18*b* prevents wax and moisture from entering the tube 10 but is nearly transparent to audio frequencies. The membrane 18*b* can be made relatively stiff so that low frequencies are attenuated. FIG. 4*d* shows an end view of the membrane of the open ear canal hearing aid system shown in FIG. 4*c*. The various tips for reducing wax and moisture buildup illustrated in FIGS. 4*a*–4*d* can also be used at the open end of ear canal tube 32.

Figure 5A:
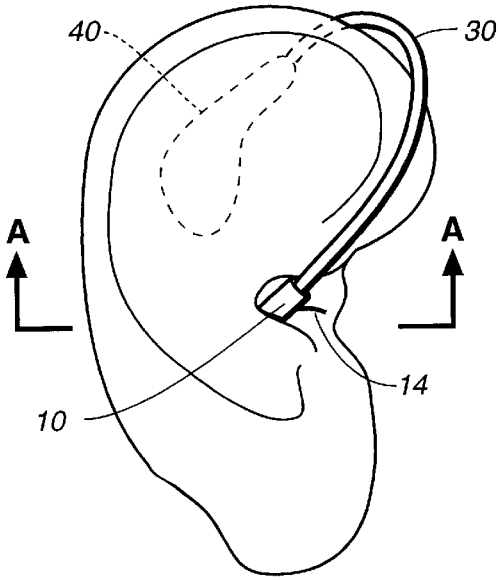
FIG. 5*a* and 5*b* show exemplary fittings of an open ear canal hearing aid system in the ear of a user according to embodiments of the present invention.
Figure 5B:
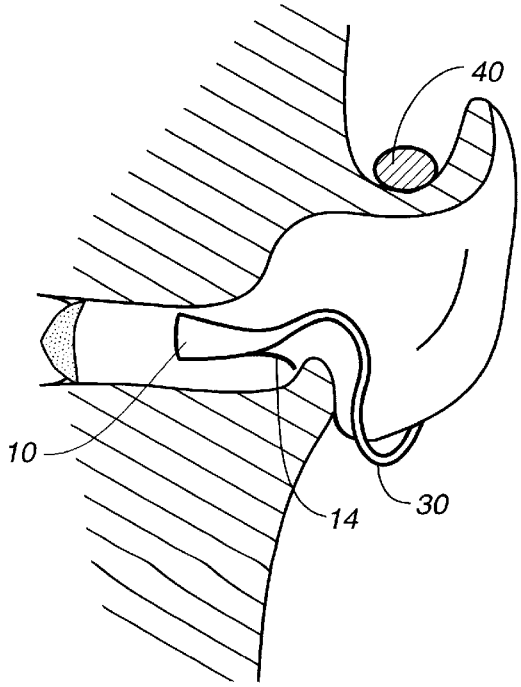

FIGS. 5*a* and 5*b* show the fitting of the open ear canal hearing aid system 1 in a BTE configuration. As shown in FIG. 5*a*, the ear canal tube 10 fits within the ear canal, and the barb 14 is positioned to hold the ear canal tube 10 in the ear canal. To better show this, a view of the fitting of the open ear canal hearing aid system along cross section "A" of FIG. 5*a* is shown in FIG. 5*b*. The hearing aid tube 30 is then formed to extend behind the ear and connected to the case 40 which is placed, for example, behind the ear. The hearing aid tube 30 can come over the top of the ear and into the ear canal as illustrated in FIG. 5*a* or can come from underneath the ear before entering the ear canal.

The ear canal tubes can be formed to fit the user in variety of different ways. For example, the best fitting tubing can be selected from a kit of manufactured tubes of different shapes and sizes. In a similar manner, the tips can be selected from a manufactured kit of tips. Thus, the user can select the tubes that fit the external ear and then select the tip that fits the ear canal shape. Another way the tubes can be formed to fit the user is by custom fitting. For example, the tubing can be made from thermo formable tubing to ensure a proper fit.

Figure 6:
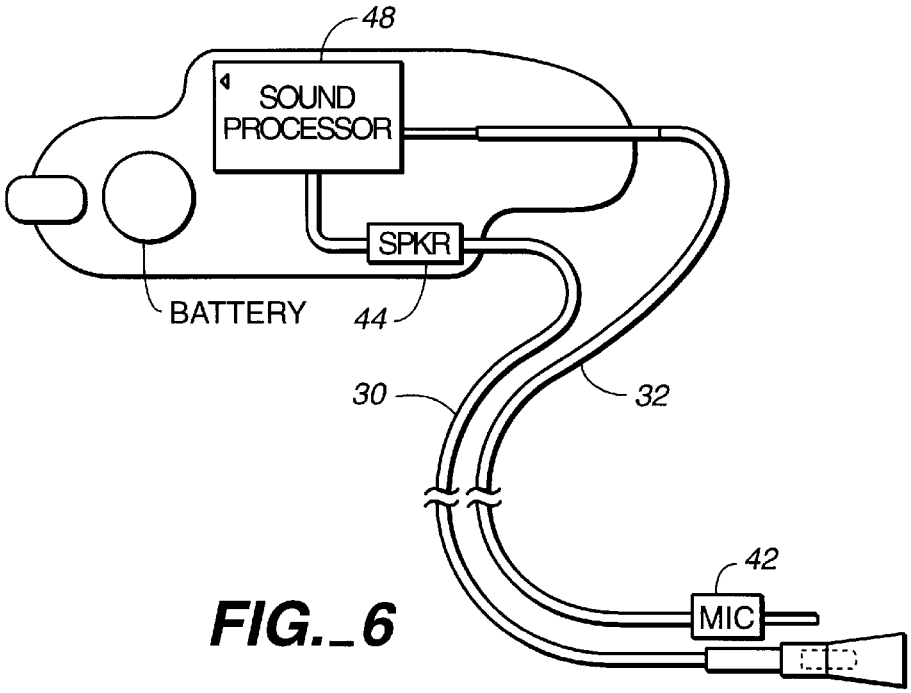
FIGS. 6–9 illustrate various positioning of the microphone and speaker in the open ear canal hearing aid system according to additional embodiments of the present invention.
Figure 7:
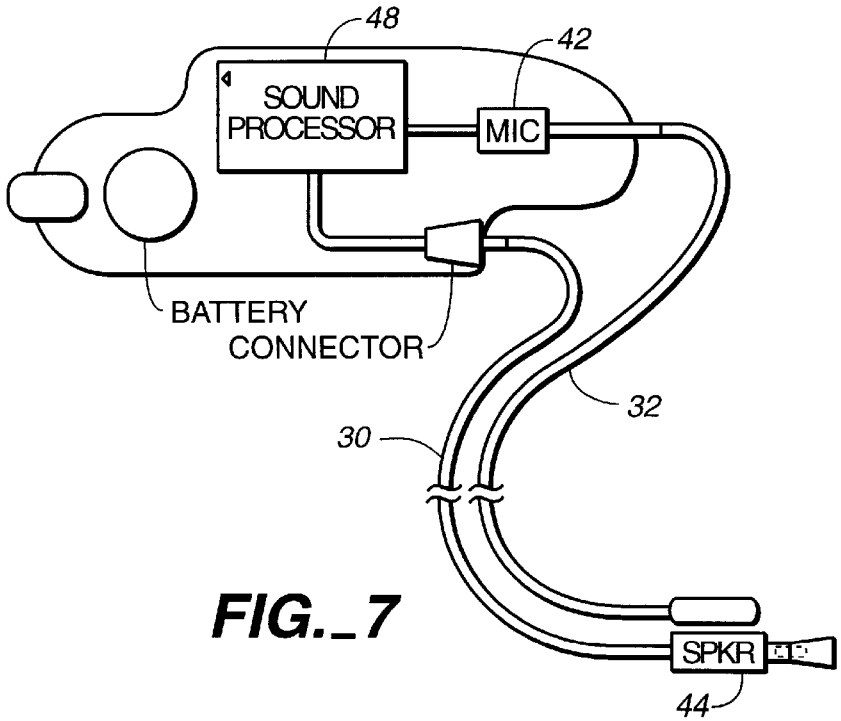
Figure 8:
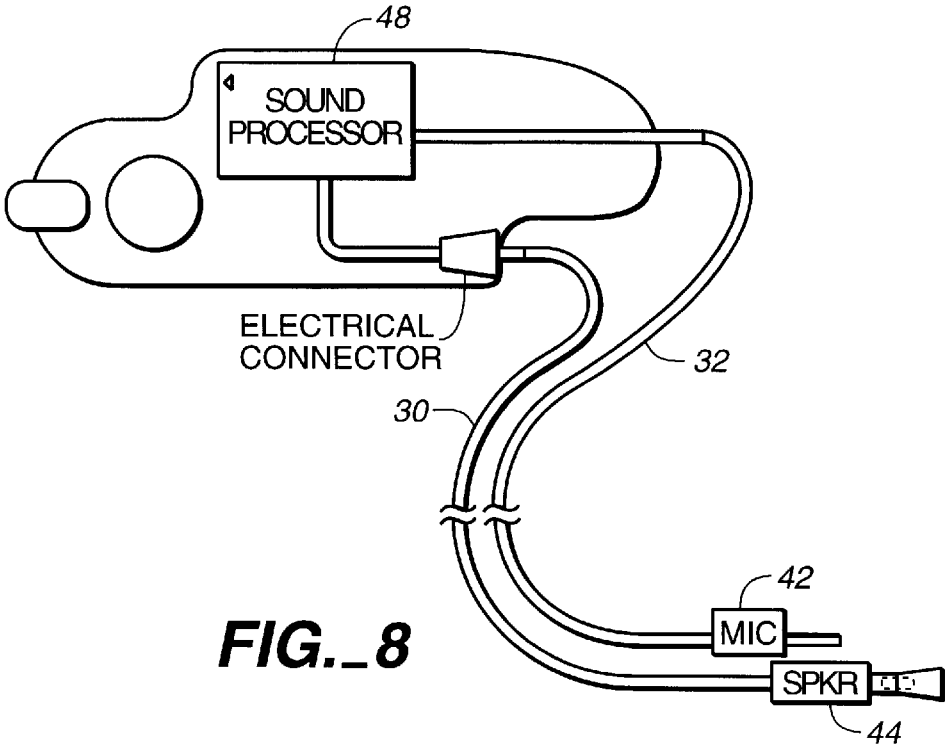

As illustrated in FIGS. 6–8, the microphone 42 and/or the speaker 44 can be moved out of the behind-the-ear component and placed at the end of the ear canal tubes 30 and 32 so as to be located within the ear canal. As noted above, the sounds which a human ear receives are filtered by the outer ear and ear canal. Thus, the sounds which travel into the ear canal have a better quality than the sounds which would be received, for example, behind the ear. Rather than using the ear canal tube 32 to transport sounds to the microphone 42, located in the behind-the-ear component, the microphone can be moved to the end of the ear canal tube 32 which is located in the ear canal, as illustrated in FIG. 6. Alternately, the microphone can stay in the behind-the-ear component and the speaker can be moved to the end of the ear canal tube 30, as illustrated in FIG. 7. Alternately, both the microphone and the speaker can be located at the ends of ear canal tubes 32 and 30, respectively, as illustrated in FIG. 8. In all of these embodiments, when either the microphone or speaker are located in the ear canal at the end of the ear canal tubes, bidirectional wires run through the tubes from the microphone and/or speaker back to the sound processing system 46. Of course any wires which run between the components placed in the ear canal, and components located outside the ear canal, can be routed in a separate tube or in the wall of any tube used for sound transmission. It will be understood by those skilled in the art that the microphone and speaker can also be located anywhere between the case 40 and the end of the ear canal tube(s).

Figure 9:
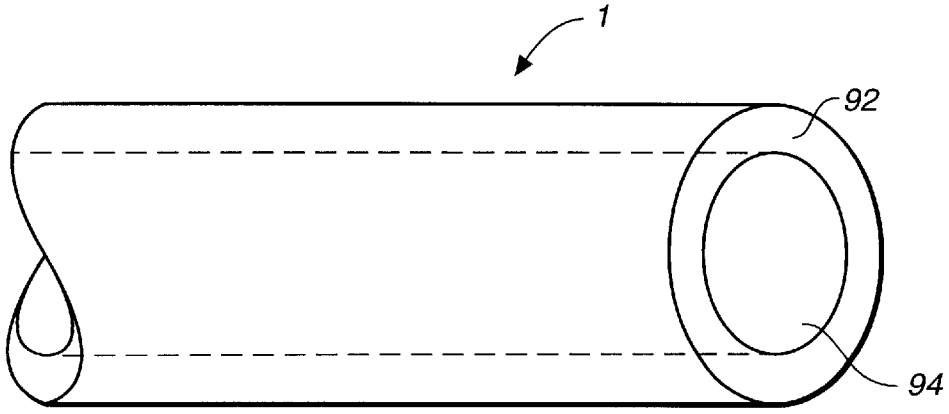

It will be understood by those skilled in the art that the earpiece can be configured to fit in the ear canal so long as the canal is at least partially open for receiving ambient sounds. For example, the earpiece 90 can be shaped like an open cylinder with thick walls 92, wherein the opening 94 in the middle of the cylinder allows ambient sounds to enter the ear canal and all of the electrical components are located in the walls of the cylinder, as illustrated in FIG. 9, but the invention is not limited thereto.

Figure 10:
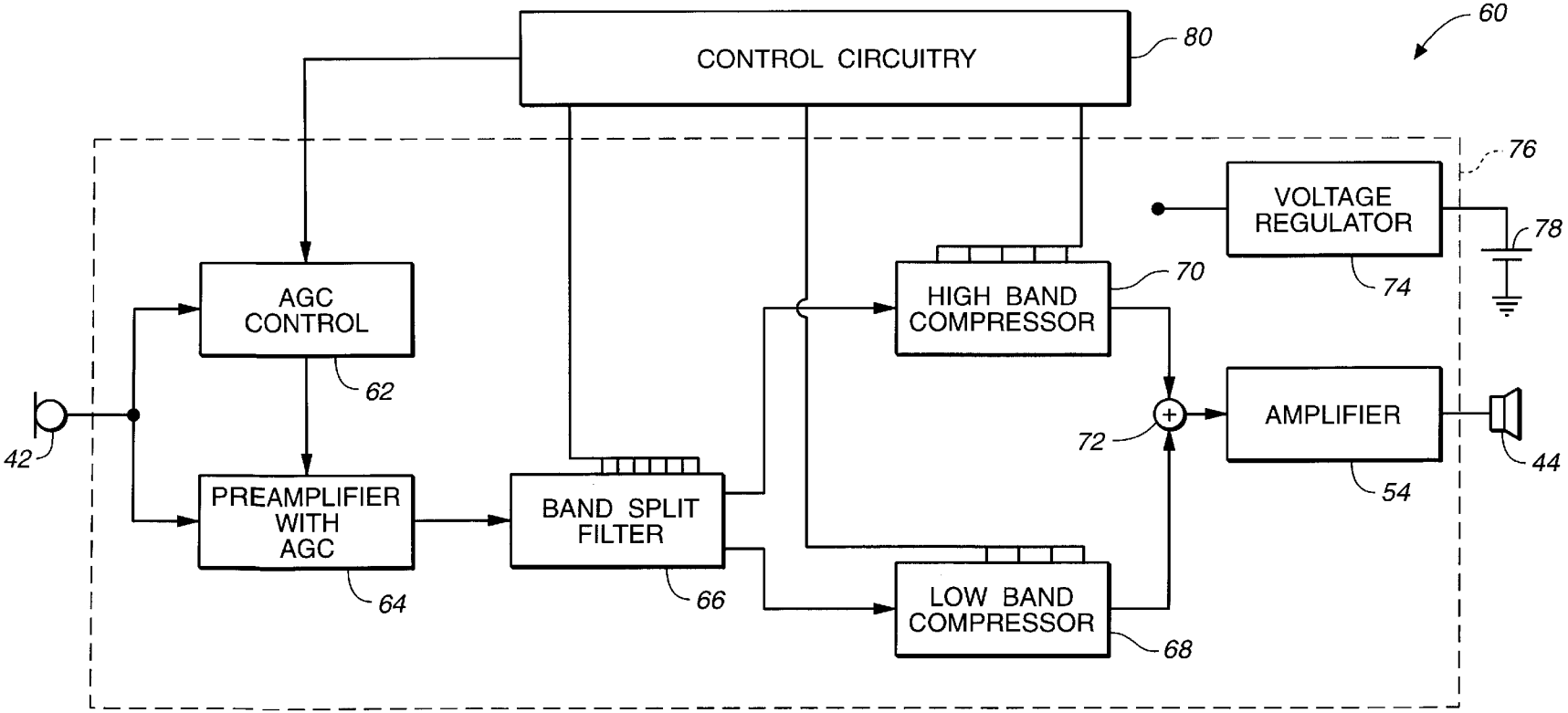
FIG. 10 is a functional block diagram of the circuitry enclosed in the case of the open ear canal hearing aid system according to one embodiment of the present invention.

FIG. 10 illustrates a block diagram of exemplary circuitry enclosed by the case 40 according to one embodiment of the present invention. A programmable multiband compressor system 60 receives a sound signal from an input 42 such as a microphone, a telecoil, or by direct audio input. The output of, for example, the microphone 42 is coupled a preamplifier 64 and an automatic gain control circuit (AGC) 62. The output of the preamplifier in the automatic gain control circuit 62 is coupled to a programmable band split filter 66, which separates the audio signal into plural (for example, high and low) frequency bands. In the FIG. 10 embodiment, the low frequency band output of the programmable band split filter 66 is coupled to a programmable compressor 68 and the high frequency band output of the programmable band split filter 66 is coupled to a programmable compressor 70. The outputs of the low band compressor 68 and the high band compressor 70 are coupled to respective inputs of a summing circuit 72, which combines the output signals to produce a composite audio signal. The composite audio signal is then applied to an amplifier which amplifies the composite audio signal to a level sufficient to drive the speaker 44.

The system 60 further includes a voltage regulator 74 for supplying a regulated voltage to various circuits of the system 60. The programmable multiband compressor system 60 can be powered by a single cell, low voltage battery 78.

The programmable multiband compressor system 60 is adapted to receive a plurality of control signals which can be generated by an external control circuit 80. The control circuit 80 is coupled to the band split filter 66 and the low and high band compressors 68 and 70, respectively. The control signals generated by the control circuit 80 are adapted to control the frequency split between the low and high frequency band as well as the gain and compression ratio of the low and high frequency compressor 68 and 70, to generate a desired response for the system to compensate for virtually any type of hearing impairment.

Because people with mild hearing losses make up the largest segment of hearing aid users, an exemplary embodiment of the FIG. 1 open ear hearing canal system 1 is configured for these users. Therefore, a predetermined frequency and amplitude range that is detected for correcting these mild hearing losses includes a range of sounds at high frequencies and low amplitudes. High frequency sounds are, for example, considered to be sounds having frequencies greater than 1000 Hz or any other specified frequency band, and low frequency sounds are considered to be sounds having frequencies less than 1000 Hz or any other specified frequency band which is different from the designated high frequency band. Exemplary low amplitude sounds are those with less than 60 to 70 decibels of sound pressure level (dB SPL) or any other specified range of audible sound.

For many mild hearing loss users, there is no hearing loss in the low frequency range. Thus, at low frequencies, the dynamic range is normal and there is no need for compression. Instead of the traditional approach of linearly processing low frequency sounds with low gain, according to exemplary embodiments of the present invention, the low frequency sounds are transmitted using the natural pathway of the ear canal. This eliminates the distortion of loud low frequency signals that can be caused by compression or gain and which can degrade speech intelligibility.

In the high frequency range, mild hearing loss users experience a reduced dynamic range and a need for compression. Gain is not needed for mild hearing loss users for loud sounds in the high frequency range. Thus, according to exemplary embodiments of the present invention, gain is only provided for soft sounds in the high frequency range. This eliminates the distortion of loud high frequency signals that can be caused by over amplification and which can degrade speech intelligibility.

According to an exemplary embodiment of the present invention, the compressors perform compression primarily on high frequency, high amplitude signals, applying the same amount of compression to the entire high frequency band. Alternately, the compressors can perform multiband compression of sound signals, applying different amounts of compression to different high frequency signals having different amplitudes and allowing the low frequency sounds to pass without compression.

When it is determined that the received sound is within the predetermined frequency and amplitude range, the compressors adjust the gain for amplifying the received sound. More particularly, the compressors adjust the gain as a function of the amplitude level detected. For instance, when the detector outputs a signal to the compressor indicating that the received sound is at a low amplitude level, a maximum gain is provided. As the amplitude level increases, the compressor reduces the gain until, for the highest amplitude levels, the maximum compression is reached, resulting in zero gain. As a result, unnecessarily high gain or distortion is prevented from adversely affecting sounds at the higher amplitude levels.

The sound processor primarily supplements the received sounds in a predetermined frequency and amplitude range. Because most mild hearing loss users have nearly normal hearing for sounds at low frequencies, it is not necessary to supplement sounds received outside of the predetermined frequency and amplitude range. Thereby, the open ear canal hearing aid system of the present invention allows these frequencies to be heard in a natural manner without amplifying or attenuating these sounds.

Figure 11:
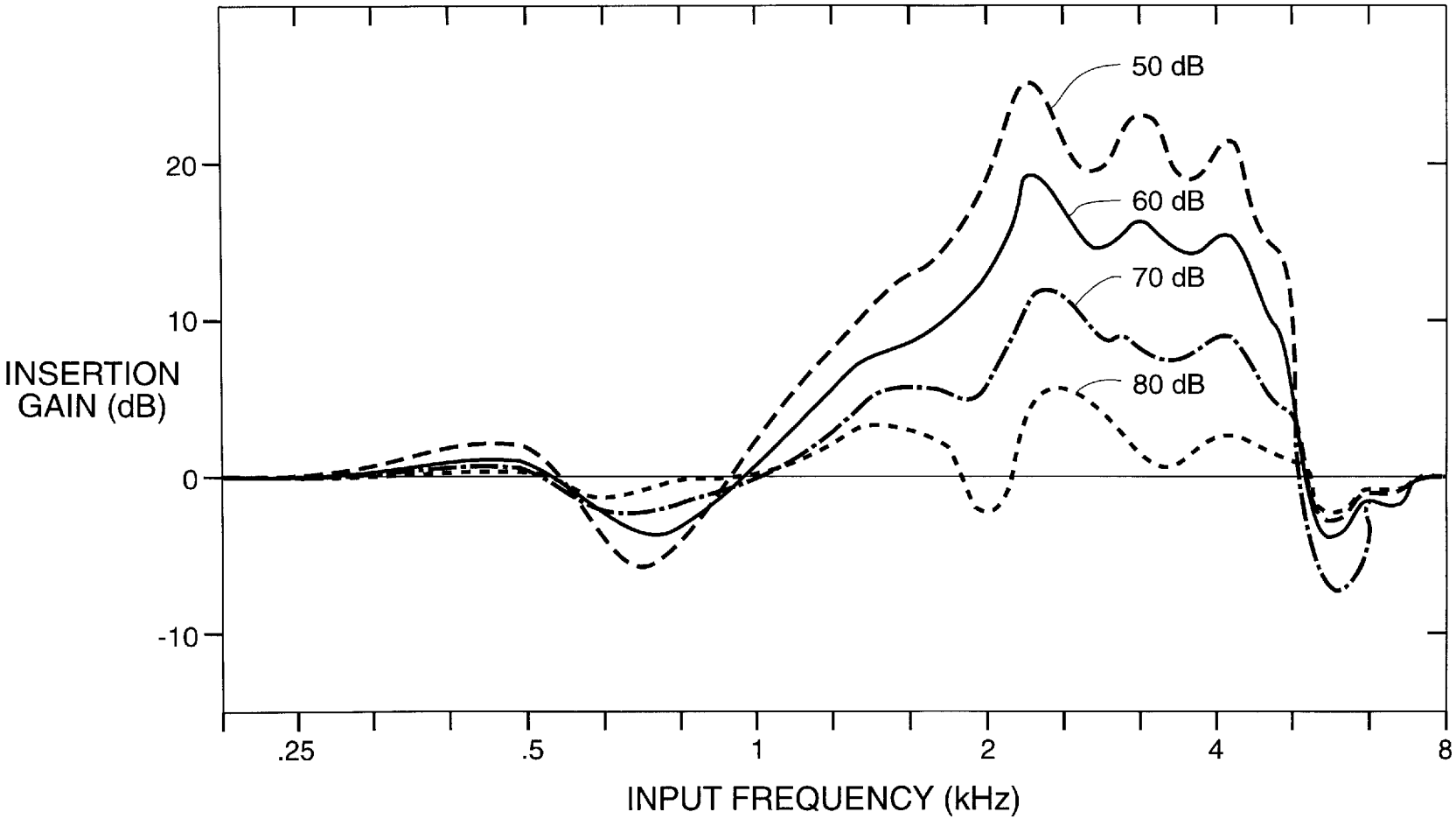
FIG. 11 is a graph which represents an example of the insertion gain provided for sounds at various frequencies received by the open ear canal hearing aid system according to one embodiment of the present invention.

FIG. 11 shows an exemplary graph of the insertion gain provided at different sound frequencies for a hearing aid system according to one embodiment of the present invention. This graph shows that there is little gain or attenuation at frequencies below 1000 Hz, while at high frequencies (greater than 1000 Hz), 20 dB of gain is present for the softest sounds and near 0 dB of gain is provided for high amplitude sounds (near 80 dB SPL). These frequency and amplitudes ranges can be determined from measurement of the environment and can be fixed in advance in the interest of simplicity.

Because of the nature of the open ear canal hearing aid system 1, there is a greater possibility of feedback than with conventional, sealed canal hearing aids. That is, with an open ear canal, sound emanates from the open canal with little attenuation. The microphone 42 picks up sound from both distant sources and sound coming out of the ear canal. The sound coming out of the ear canal can cause feedback. This feedback problem can be solved by lowering the gain or by using feedback cancellation circuits, such as that described in U.S. patent application Ser. No. (Attorney Docket No. 022577-365) Entitled "Noise Cancellation Earpiece", filed on even date herewith, the contents of which are hereby incorporated by reference in their entirety.

The invention being thus described, it will be apparent to those skilled in the art that the same can be varied in many ways. Such variations are not to be regarded as a departure from the spirit and scope of the invention, which is determined by the following claims. All such modifications that would be obvious to those skilled in the art are intended to be included within the scope of the following claims.

What is claimed is:

1. An open ear canal hearing aid system, comprising:

a first ear canal tube sized for positioning in an ear canal so that the ear canal is at least partially open for directly receiving ambient sounds, wherein said first ear canal tube has a first end in said ear canal with an opening for receiving said ambient sounds and a second end connected to an input of a microphone;

sound processing means for processing the ambient sound signals produced by said microphone within a predetermined amplitude and frequency range to produce processed sounds; and a second ear canal tube sized for positioning in the ear canal so that the ear canal is at least partially open for directly receiving ambient sounds, wherein said second ear canal tube transports processed sounds into the ear canal.

2. An open ear canal hearing aid system according to claim 1, wherein the predetermined amplitude and frequency range is selected for a predetermined level of hearing loss.

3. An open ear canal hearing aid system according to claim 1, wherein said ear canal tubes have an inside diameter of less than 0.03 inches and an outside diameter of less than 0.05 inches.

4. An open ear canal hearing aid system according to claim 1, wherein said second ear canal tube comprises a barb at a tip securing said second ear canal tube in the ear canal of the user.

5. An open ear canal hearing aid system according to claim 1, further comprising:

means for reducing feedback due to sound emanated from the ear canal.

6. An open ear canal hearing aid system according to claim 1, wherein said sound processor includes a multiband compressor system for dividing the ambient sound signals into plural frequency bands and for providing different sound processing to each band.

7. An open ear canal hearing aid system, comprising:

a first ear canal tube sized for positioning in an ear canal so that the ear canal is at least partially open for directly receiving ambient sounds, wherein said first ear canal tube has a first end in said ear canal with an opening for receiving said ambient sounds and a second end connected to an input of a microphone;

sound processing means for processing the ambient sound signals produced by said microphone within a predetermined amplitude and frequency range to produce processed sounds; and a second ear canal tube sized for positioning in the ear canal so that the ear canal is at least partially open for directly receiving ambient sounds, wherein said ear canal tube contains a speaker located in said ear canal for broadcasting processed sounds.

8. An open ear canal hearing aid system according to claim 7, wherein the predetermined amplitude and frequency range is selected for a predetermined level of hearing loss.

9. An open ear canal hearing aid system according to claim 7, wherein said first ear canal tube has an inside diameter of less than 0.03 inches and an outside diameter of less than 0.05 inches.

10. An open ear canal hearing aid system according to claim 7, wherein said second ear canal tube comprises a barb at a tip securing said second ear canal tube in the ear canal of the user.

11. An open ear canal hearing aid system according to claim 7, further comprising:

means for reducing feedback due to sound emanated from the ear canal.

12. An open ear canal hearing aid system according to claim 7, wherein said sound processor includes a multiband compressor system for dividing the ambient sounds into plural frequency bands and for providing different sound processing to each band.

13. An open ear canal hearing aid system, comprising:

a first ear canal tube sized for positioning in an ear canal so that the ear canal is at least partially open for directly receiving ambient sounds, wherein said first ear canal tube has a microphone located at one end of the tube in the ear canal for receiving ambient sounds and for producing sound signals;

sound processing means located outside of said ear canal for processing the sound signals produced by the microphone within a predetermined amplitude and frequency range to produce processed sounds, wherein said sound signals are transmitted from the microphone to the sound processing means by wires in said first ear canal tube; and a second ear canal tube sized for positioning in the ear canal so that the ear canal is at least partially open for directly receiving ambient sounds, wherein said second ear canal tube transports processed sounds into the ear canal.

14. An open ear canal hearing aid system according to claim 13, wherein the predetermined amplitude and frequency range is selected for a predetermined level of hearing loss.

15. An open ear canal hearing aid system according to claim 13, wherein said second ear canal tube has an inside diameter of less than 0.03 inches and an outside diameter of less than 0.05 inches.

16. An open ear canal hearing aid system according to claim 13, wherein said second ear canal tube comprises a barb at a tip securing said second ear canal tube in the ear canal of the user.

17. An open ear canal hearing aid system according to claim 13, further comprising:

means for reducing feedback due to sound emanated from the ear canal.

18. An open ear canal hearing aid system according to claim 13, wherein said sound processor includes a multiband compressor system for dividing the ambient sounds into plural frequency bands and for providing different sound processing to each band.

19. An open ear canal hearing aid system, comprising:

a first ear canal tube sized for positioning in an ear canal so that the ear canal is at least partially open for directly receiving ambient sounds, wherein said first ear canal tube has a microphone located at the end of the tube in the ear canal for receiving ambient sounds and for producing sound signals;

sound processing means for processing the sound signals produced by the microphone within a predetermined amplitude and frequency range to produce processed sounds, wherein said sound signals are transmitted from the microphone to the sound processing means by wires in said first ear canal tube; and a second ear canal tube sized for positioning in the ear canal so that the ear canal is at least partially open for directly receiving ambient sounds, wherein said second ear canal tube has a speaker located at one end of the tube located in the ear canal for broadcasting processed sounds into the ear canal.

20. An open ear canal hearing aid system according to claim 19, wherein the predetermined amplitude and frequency range is selected for a predetermined level of hearing loss.

21. An open ear canal hearing aid system according to claim 19, wherein said ear canal tubes have an inside diameter of less than 0.03 inches and an outside diameter of less than 0.05 inches.

22. An open ear canal hearing aid system according to claim 19, wherein said second ear canal tube comprises a barb at a tip securing said second ear canal tube in the ear canal of the user.

23. An open ear canal hearing aid system according to claim 19, further comprising:

means for reducing feedback due to sound emanated from the ear canal.

24. An open ear canal hearing aid system according to claim 19, wherein said sound processor includes a multiband compressor system for dividing the ambient sounds into plural frequency bands and for providing different sound processing to each band.

25. An open ear canal communications earpiece, comprising:

a microphone means for detecting ambient sounds in an ear canal;

sound processing means for processing the ambient sound signals produced by said microphone within a predetermined amplitude and frequency range to produce processed signals; and speaker means for broadcasting processed signals into said ear canal, wherein said communications earpiece is positioned in said ear of a user so that the ear canal is at least partially open for directly receiving ambient sounds.

26. An open ear canal communications earpiece according to claim 25, wherein the predetermined amplitude and frequency range is selected for a predetermined level of hearing loss.

27. An open ear canal communications earpiece according to claim 25, further comprising:

means for reducing feedback due to sound emanated from the ear canal.

28. An open ear canal communications earpiece according to claim 25, wherein said sound processor includes a multiband compressor system for dividing the ambient sounds into plural frequency bands and for providing different sound processing to each band.

29. An open ear canal communications earpiece according to claim 25, wherein said open ear communications earpiece acts as a hearing aid system, and wherein said sound processing means does not amplify low frequency sound, the system relying on the open ear canal transmission of low frequency ambient sounds.

30. An open ear canal communications earpiece, comprising:

a microphone means for detecting ambient sounds in an ear canal;

sound processing means for processing the ambient sound signals produced by said microphone within a predetermined amplitude and frequency range to produce processed signals; and speaker means for broadcasting processed signals into said ear canal, wherein said communications earpiece is positioned in said ear of a user so that the ear canal is at least partially open for directly receiving ambient sounds, wherein said sound processing means does not amplify low frequency sound, the system relying on the open ear canal transmission of low frequency ambient sounds.

* * * * *